US006286324B1

(12) United States Patent
Pastryk et al.

(10) Patent No.: US 6,286,324 B1
(45) Date of Patent: Sep. 11, 2001

(54) ICE LEVEL SENSING SYSTEM FOR AN ICE MAKER

(75) Inventors: Jim J Pastryk, Sawyer; Donald E. Janke, Benton Harbor; Mark H. Nelson, Berrien Springs, all of MI (US); Daryl Lee Harmon, Evansville, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 09/482,397

(22) Filed: Jan. 12, 2000

Related U.S. Application Data

(63) Continuation-in-part of application No. 09/221,770, filed on Dec. 28, 1998, now Pat. No. 6,050,097.

(51) Int. Cl.[7] ..... F25C 1/00
(52) U.S. Cl. ..... 62/137; 62/344
(58) Field of Search ..... 62/137, 344

(56) References Cited

U.S. PATENT DOCUMENTS

| | | | |
|---|---|---|---|
| 3,545,217 | 12/1970 | Linstromberg | 62/137 |
| 3,635,043 | 1/1972 | Sterling | 62/137 |
| 4,649,717 | 3/1987 | Tate, Jr. et al. | 62/340 |
| 4,756,165 | 7/1988 | Chestnut et al. | 62/135 |
| 4,920,336 | 4/1990 | Meijer | 340/169 |
| 4,984,462 | 1/1991 | Hass, Jr. et al. | 340/619 |
| 5,160,094 | 11/1992 | Willis et al. | 62/137 |
| 5,272,888 * | 12/1993 | Fisher et al. | 62/344 |
| 5,361,602 * | 11/1994 | Furukawa et al. | 62/344 |

* cited by examiner

*Primary Examiner*—Corrine McDermott
*Assistant Examiner*—Mohammad M Ali
(74) *Attorney, Agent, or Firm*—Stephen D. Krefman; Robert O. Rice; Joel M. Van Winkle

(57) ABSTRACT

An ice level sensing system for use on a refrigerator including a freezer compartment having top wall, opposite side walls and an access opening. A door is provided for closing the access opening. An ice maker is disposed within the freezer compartment adjacent the top wall for forming ice pieces. An ice storage bin is removably mounted to the door below the ice maker for receiving ice pieces from the ice maker. An emitter element, supported on a side wall of the freezer, emits a beam of light across the upper portion of the bin. A receiver element, supported on a freezer side wall opposite the emitter element, receives the beam of light wherein beam of light travels between the emitter element and the receiver element along a line of sight path. A paddle is rotatably supported on a freezer side wall for blocking the line of sight when the door is open. In addition, a movable member may be provided, supported on a freezer side wall opposite the paddle, which may be selectively movable between an ON position and an OFF position wherein in the OFF position the movable member blocks the line of sight.

21 Claims, 9 Drawing Sheets

ICE LEVEL SENSING SYSTEM FOR AN ICE MAKER

This is a continuation-in-part of application Ser. No. 09/221,770, entitled "ICE MAKING AND STORAGE SYSTEM FOR A REFRIGERATOR", filed on Dec. 28, 1998 now U.S. Pat. No. 6,050,097.

The entire specification and drawings thereof being hereby incorporated by reference into the present spec.

BACKGROUND OF THE INVENTION

1. Field of the Invention

The invention relates to an ice making system for a refrigerator and more particularly to an ice level sensing system for an ice maker.

2. Description of Related Art

Automatic ice making systems for use in a home refrigerator are well known. Typically, ice making systems include an ice maker mounted within the freezer compartment of the refrigerator and an ice storage receptacle or bin supported beneath the ice maker for receiving the formed ice from the ice maker. The ice maker is commonly mounted within the freezer compartment adjacent the side or rear wall of the freezer compartment such that water and power can be readily supplied to the ice maker. The ice storage receptacle is supported by a shelf structure beneath the ice maker within the freezer compartment. The ice storage receptacle generally extends across the freezer compartment and has a front end adjacent the freezer door. U.S. Pat. No. 4,942,979, to Linstromberg et al. is an example of a prior art ice making system.

In the design of ice maker systems for refrigerators, it is recognized that a control system must be provided for sensing the level of ice disposed in the ice storage bin such that ice pieces are produced when insufficient ice is in the storage bin and ice pieces are not produced when the ice storage bin is filled. A typical ice level sensing system, illustrated by U.S. Pat. No. 5,160,094, to Willis et al., includes an ice maker which employs a bail arm which is periodically lowered into the ice storage bin and then raised back out of the ice storage bin. If the presence of ice pieces interferes with the bail arm being lowered into the ice storage bin, the ice maker is deenergized such that more ice pieces are not produced.

Conventional ice level sensing systems such as the one disclosed by Willis et al. are not easily applied to a refrigerator ice making system having a door mounted ice storage bin. Door mounted ice storage bins offer several advantages—including making more space available for freezer shelving. However, if a conventional bail arm type ice level sensing system is used with a door mounted ice storage bin, damage may readily occur to the bail arm if the refrigerator door is opened when the bail arm is being lowered into the ice storage bin.

U.S. Pat. No. 3,635,043, to Sterling, is directed to a refrigeration system including a door mounted ice storage receptacle. Sterling discloses having a photoelectric system—employing an incandescent lamp 54 and a photocell 55—for sensing the level of ice in the door mounted bin. The lamp 54 is continuously on and shines a light beam across an ice storage bin. When the beam of light is interrupted by accumulated ice, ice harvesting is prevented.

One problem that exists with door mounted ice storage bins is untimely dispensing of ice pieces when the freezer door is open. Accordingly, for door mounted ice bin systems, some means must be provided for preventing the discharge of ice pieces when the freezer door is opened.

Another issue, common to all ice makers used in refrigerators, is the provision of a convenient on/off switch. It is desirable to have a convenient on/off switch such that the ice making system can be disabled during long periods of non-use.

Accordingly, there is a need for robust and effective ice maker control system which may be conveniently employed to sense the level of ice in an ice storage receptacle. In particular, there is a need for a simple and effective ice level sensing system for use with a door mounted ice storage bin.

SUMMARY OF THE INVENTION

The present invention is directed to door mounted ice storage bin systems for use in the freezer compartment of a refrigerator and in particular to a system for ensuring that ice pieces are not dispensed when the door of the refrigerator is open.

The present invention is more particularly directed to a refrigerator including a freezer compartment having top wall, opposite side walls and an access opening. A door is provided for closing the access opening. An ice maker is disposed within the freezer compartment adjacent the top wall for forming ice pieces. An ice storage bin is removably mounted to the door below the ice maker for receiving ice pieces from the ice maker. An emitter element, supported on a side wall of the freezer, emits a beam of light across the upper portion of the bin. A receiver element, supported on a freezer side wall opposite the emitter element, receives the beam of light wherein beam of light travels between the emitter element and the receiver element along a line of sight path. A paddle is rotatably supported on a freezer side wall for blocking the line of sight when the door is open.

In addition, a movable member may be provided, supported on a freezer side wall opposite the paddle, which may be selectively movable between an ON position and an OFF position wherein in the OFF position the movable member blocks the line of sight.

DESCRIPTION OF THE PREFERRED EMBODIMENTS

Figure 1:
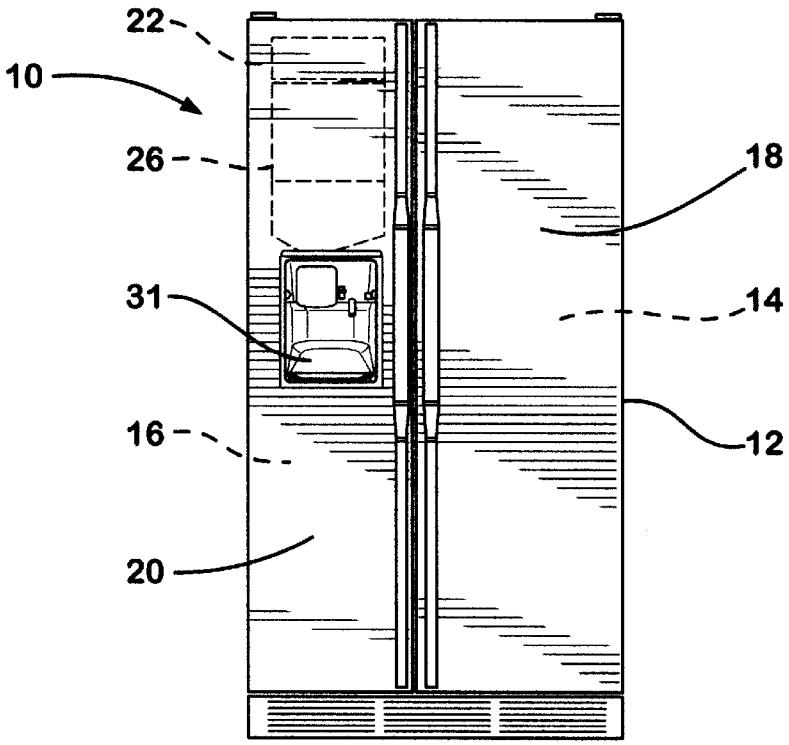
FIG. 1 is a front view of a refrigerator apparatus having an ice storing and dispensing system embodying the present invention.
Figure 2:
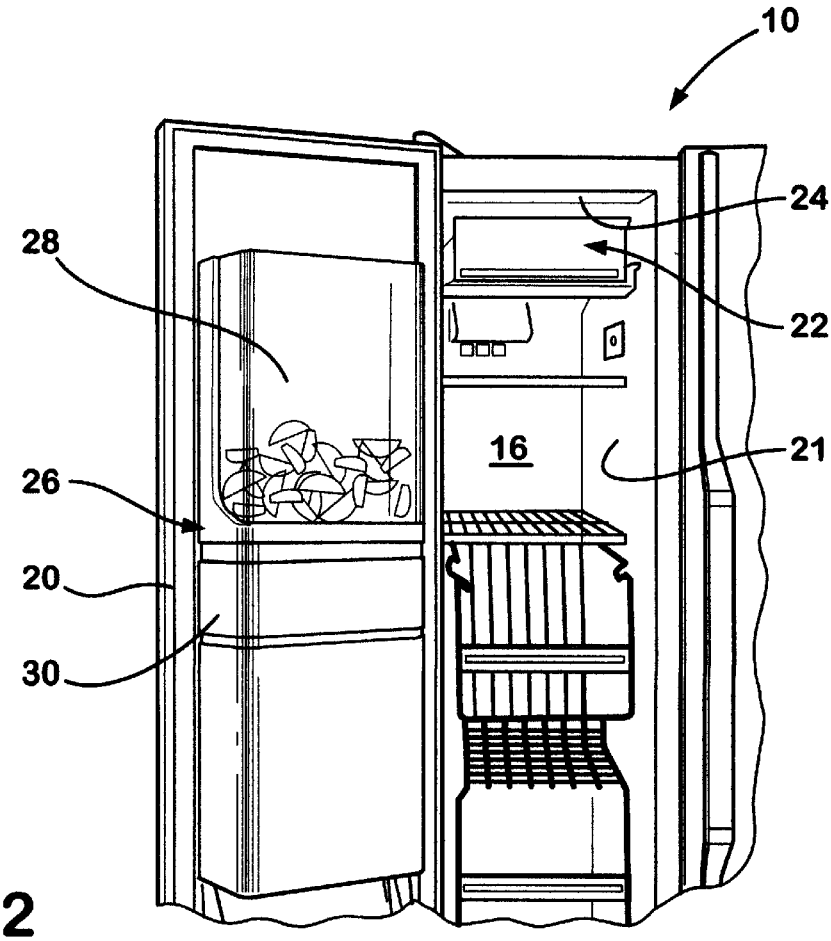
FIG. 2 is a fragmentary perspective view illustrating the ice storing and dispensing system within the freezer compartment of the refrigerator apparatus with the freezer door open.
Figure 3:
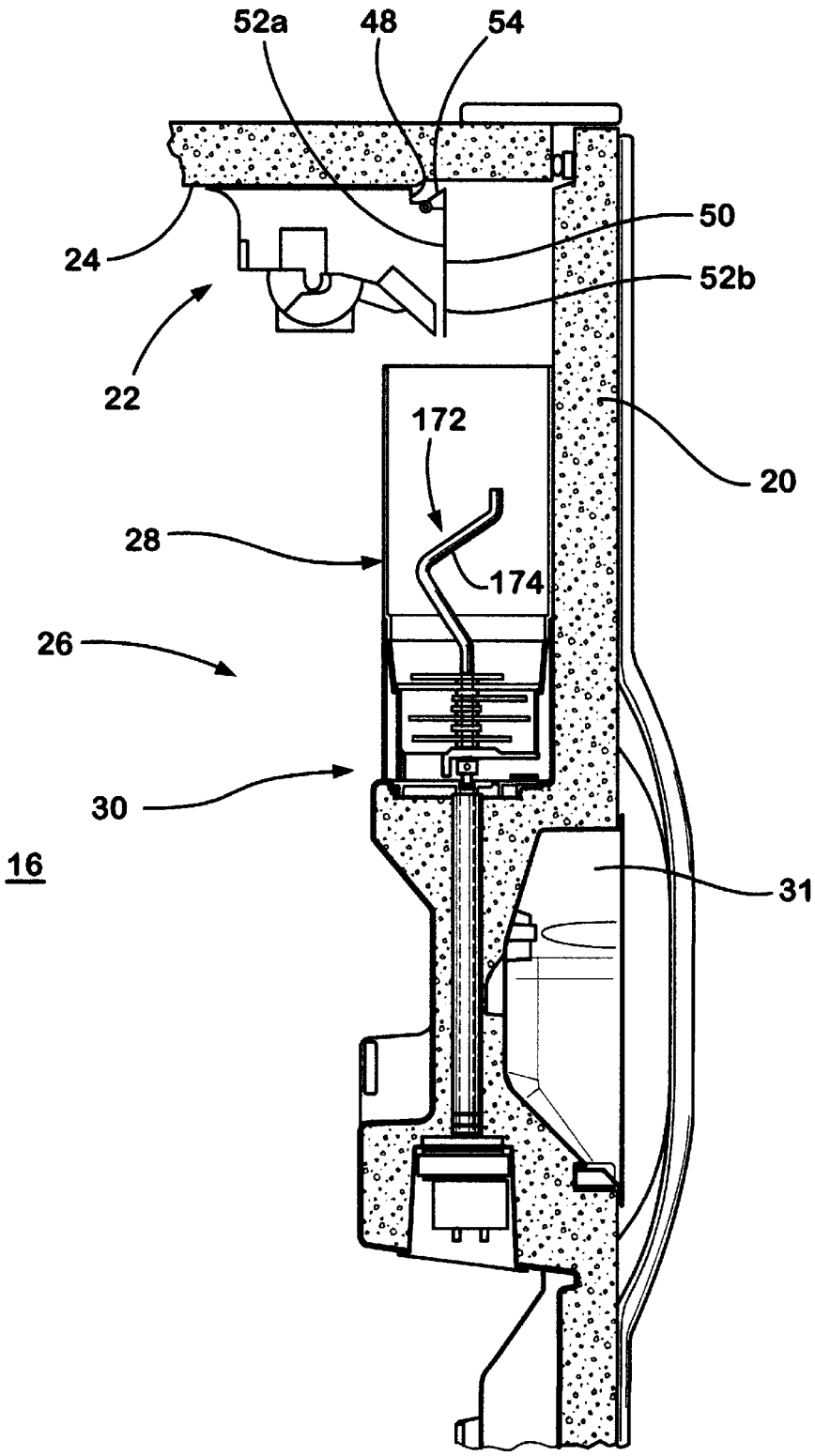
FIG. 3 is a fragmentary, side sectional view of the ice storing and dispensing system of FIG. 1.

In the illustrative embodiment of the invention as shown in FIGS. 1–3, a refrigerator 10, comprising a side-by-side fresh food/freezer configuration, is provided having a cabinet 12 forming an above freezing fresh food compartment 14 and a below freezing freezer compartment 16. Both the fresh food compartment 14 and the freezer compartment 16 are provided with access openings. A fresh food closure member or door 18 and a freezer closure member or door 20 are hingedly mounted to the cabinet 12 for closing the access openings, as is well known.

An ice making assembly 22 is disposed within the freezer compartment 16 having side walls 21 and 23 (see FIG. 4) and a top wall 24. The ice making assembly 22 is mounted to the inside surface of the top wall 24 of the freezer compartment 16. An ice dispensing system 26, mounted to the freezer door 20, is provided below the ice making assembly 22 for receiving ice pieces therefrom. The ice dispensing system 26 includes an ice storage receptacle or bin 28 having an ice crushing system 30. When operated, the ice dispensing system 26 transfers ice pieces from the bin 28 through the freezer door 20 whereby ice pieces may be dispensed through a conventional, forwardly exposed ice dispenser station or external ice service area 31.

Figure 4:
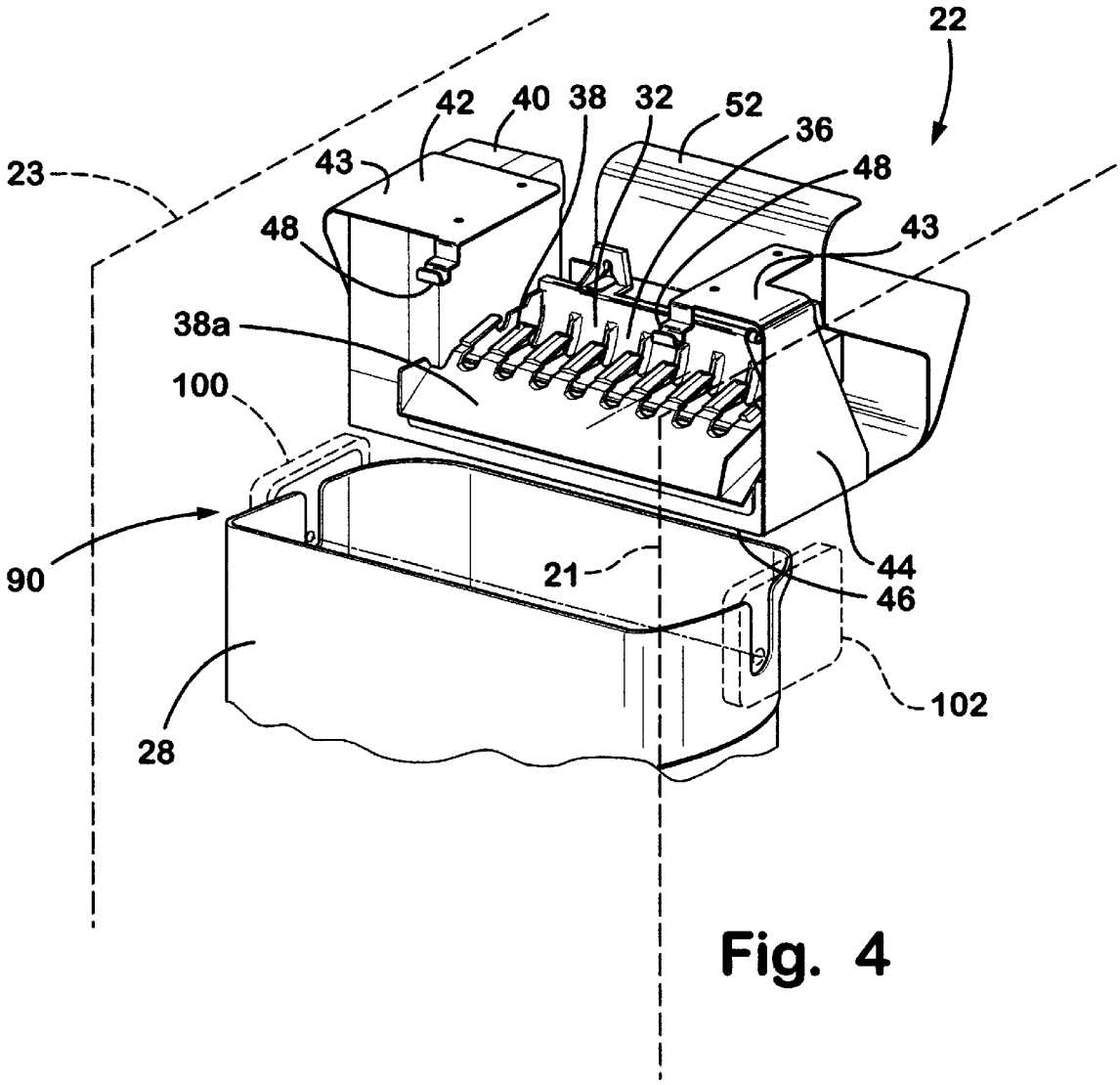
FIG. 4 is a fragmentary, perspective view of the ice storage and dispensing system of the present invention wherein the front cover of the ice maker has been removed.

The present invention may be beneficially employed with any type of known ice maker. In the preferred embodiment, as shown in FIG. 4, the ice maker assembly 22 is a conventional ice piece making apparatus which forms crescent shaped ice pieces. The ice maker 22 includes an ice mold body 36, an ice stripper 38, a rotatable ejector (not shown) and a control module 40. The ice stripper 38 includes a ramp 38*a* for directing harvested ice into the ice storage bin 28. The ramp 38*a* may be integrally formed with the ice stripper, as shown, or may be a separate member. The control module surrounds a control motor (not shown) and gearing system (not shown) which operate to rotate the ejector when ice pieces are ready for harvesting. The ice makers disclosed in U.S. Pat. Nos. 4,649,717 and 5,160,094, herein incorporated by reference, are illustrative of the type of ice maker used in the present invention.

The ice maker 22 may be supported by a mounting bracket 42 along the upper, front portion of the freezer compartment 16. The mounting bracket 42 is attached to the top wall 24 (FIG. 3) of the freezer compartment and forms a member having a generally U-shaped cross section. The bracket 42 includes top mounting surfaces 43 which attach to the top wall 24. Side walls 44 extend downwardly along the sides of the ice maker 22. A bottom wall 46 joins the side walls 44 and forms a heat shield beneath the bottom of the ice maker 22. The ice maker 22 is attached to the mounting bracket 42 via mounting legs (not shown). An air baffle member 52 may be connected to the back of the ice maker 22 to direct the flow of air within the freezer compartment 16 across the ice mold 36 but is certainly not necessary to practice the present invention.

Although disclosed herein, the manner in which the ice maker 22 is supported within the freezer compartment does not form part of the invention and may be readily varied—as can be appreciated by those skilled in the art. For example, the ice maker may be supported on bracket type elements extending from the side walls of the freezer compartment.

A front cover 50 (FIG. 3) is attached to the bracket in front of the ice maker 22. The front cover 50 is a generally flat member or wall having a back surface 52*a* and a front surface 52*a* and is pivotably supported in front of the ice maker 22. To pivotably support the cover 50, the bracket 42 may include tabs 48. A pair of support extensions 54 extending from the back surface 52*a* are rotatably captured by the tabs 48 and allow the cover 50 to swing or pivot about the tabs 48.

In the disclosed embodiment, when ice pieces are ready to be harvested from the ice mold body 36, the ejector and stripper 38 cooperate to remove ice pieces from the mold body 36 and urge the harvested ice pieces to slide forwardly along the stripper 38. The ice pieces slide forward off the stripper 38 and are directed to slide down the ramp 38*a*. The spacing between the back wall of the cover 50 and the bottom edge of the ramp 38*a* is such that ice pieces are not able to fit through the elongated gap which separates the ramp 38*a* and the cover 50. Accordingly, ice pieces sliding down the ramp 38*a* make contact with the cover 50. However, the mass of the ice pieces and the slope of the ramp 38*a* is such that the ice pieces push the cover 50 forward upon contact, rotating the cover 50 about the tabs 48, wherein the ice pieces are able to fall into the storage bin 28 which is supported by the freezer door 20.

An optic control system is provided to prevent ice harvesting when the ice storage bin 28 is full of ice pieces. The need for this function is well recognized in the ice maker art. If ice harvesting is not appropriately controlled, the ice maker 22 may make an excessive quantity of ice and overfill the ice storage receptacle 28. In an optical ice level sensing system, light (electromagnetic radiation of any wavelength) is used to sense the presence of ice pieces. An optical ice level sensing system takes advantage of the fact that ice pieces formed by a conventional ice maker, as described above, have a cloudy core which is due to air bubble entrapment, crazing during the freezing process, and water impurities among other things. This cloudy core of the ice pieces blocks a wide range of wave lengths that are generated and sensed by many standard infrared (IR) radiation products.

Figure 5:
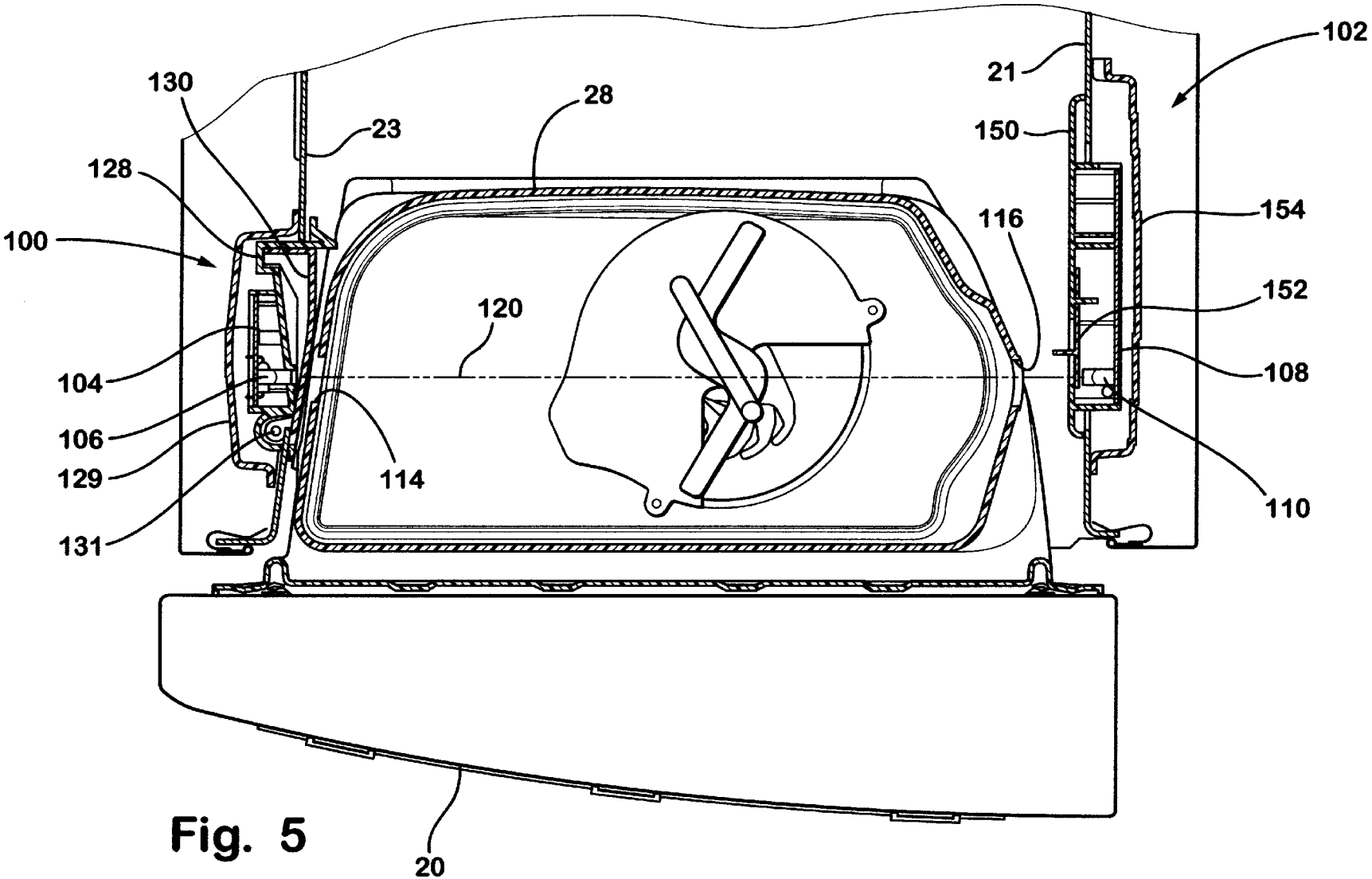
FIG. 5 is a cross sectional view taken through the upper portion of the ice storage bin along the line of sight between the optic elements.
Figure 6:
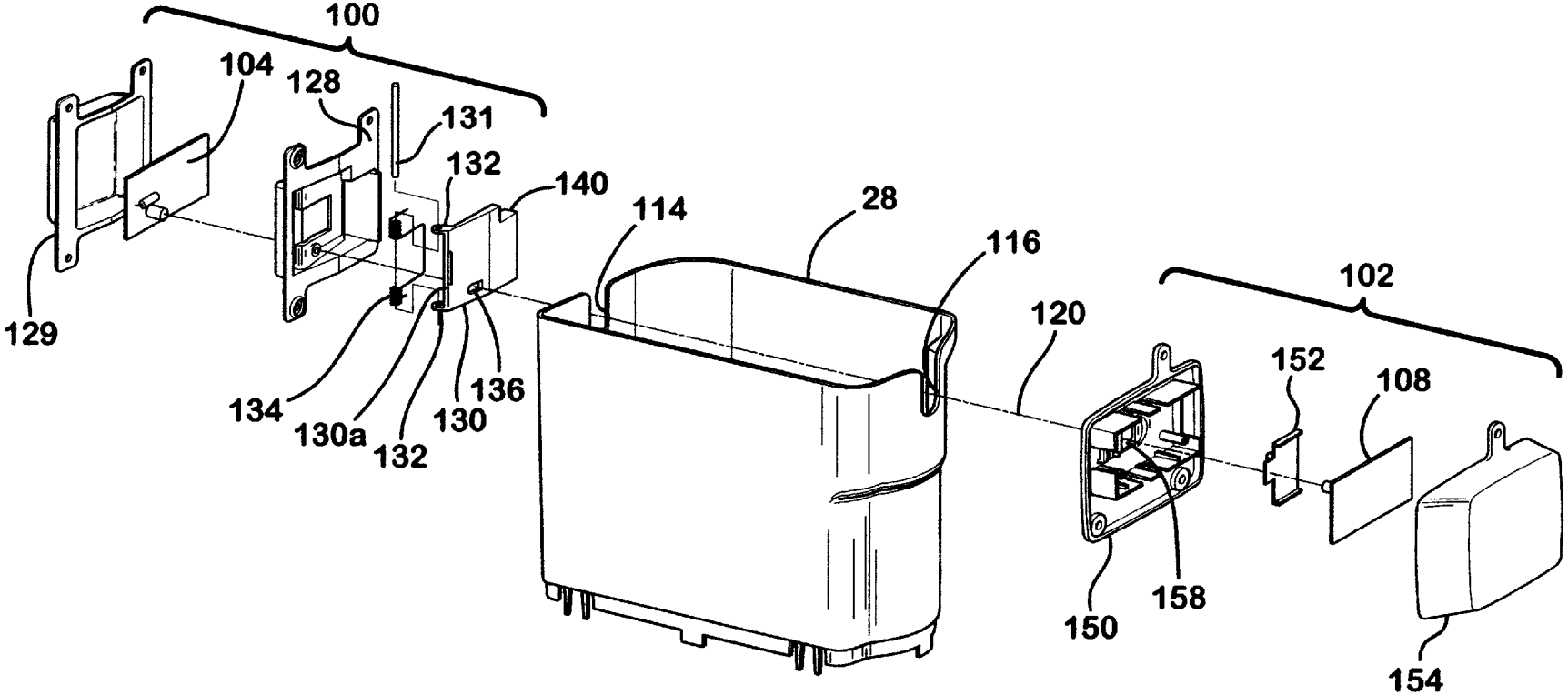
FIG. 6 is an exploded view of the upper portion of the ice storage bin, the emitter assembly and the receiver assembly of the present invention.
Figure 7:
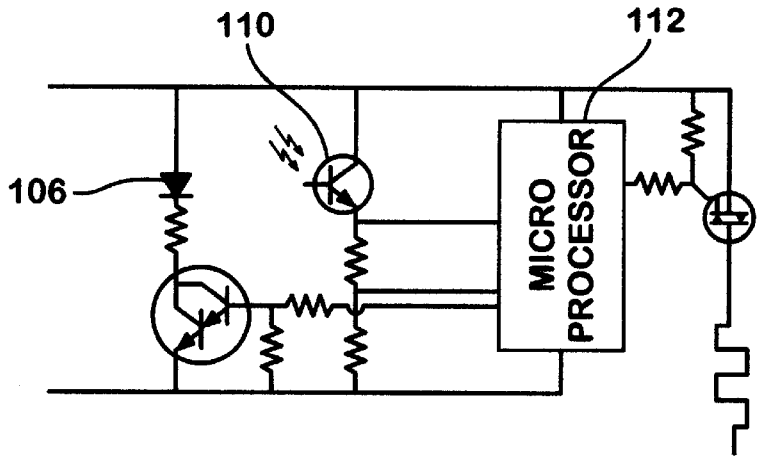
FIG. 7 is a schematic electrical diagram illustrating the circuitry of the optical control system of FIG. 6.

As shown in FIGS. 5–7, the optical ice level sensing system includes a light emitter assembly 100 and a light receiver assembly 102. The emitter assembly 100 may be mounted to the side wall 23 of the freezer compartment and the receiver assembly 102 may be mounted to the opposite side wall 21. The emitter assembly 100 includes an emitter printed circuit board (PCB) 104 supporting an infrared (IR) light emitting diode (LED) 106. The receiving assembly 102 includes a receiver printed circuit board (PCB) 108 supporting a phototransistor 110. Associated with one of the printed circuit boards or in some other suitable place there is provided a microprocessor 112 and the necessary electronic circuitry to operate the optical ice level sensing system. The microprocessor 112 controls the operation of the ice level sensing system.

A pair of slots 114 and 116 are provided on the bin 28, downwardly extending from the top edge of the bin 28. Alternatively, the slots may be openings provided on opposite side walls of the bin near the top surface of the bin 28. When the freezer door 20 is closed, the bin 28 is positioned such that a line of sight or clear path 120 is created between the LED 106 and the phototransistor 110. The slots 114 and 116 could also be omitted since the bin 28 is made from clear material through which the IR beam can readily pass.

When the ice maker 22 is ready to harvest ice pieces, IR radiation is generated by the LED 106 which is directed to pass along the path 120 through the ice storage bin 28 to be received by the phototransistor 110. As discussed above, ice pieces, due to there cloudy core, will impede the transmission of the IR radiation such that the level of the IR signal received by the receiver can be used as an indicator of the ice level. When the IR LED 106 is pulsed, if the photo transistor 110 senses an IR signal, this indicates that the ice bin 28 is not completely filled with ice and the ice maker 22 will be operated to produce and harvest more ice pieces. If the photo transistor 110 does not sense an IR signal when the LED 106 is pulsed, this indicated that the ice bin 28 is full of ice pieces and further ice will not be harvested.

One problem that arises when using a door mounted ice storage bin, such as present disclosed, is that some system must be provided to control the discharge of ice pieces from the ice maker 22 such that ice pieces are not discharged when the freezer door 20 is open. As one skilled in the art can readily appreciated, if ice pieces are discharged when the door 20 is open, the ice pieces will fall onto the floor since the ice storage bin 28 is mounted on the door 20 and will no longer be beneath the ice maker 22.

As shown in FIGS. 6 and 8–10, this problem can be solved through the use of unique paddle assembly which may be formed as part of the light emitter assembly 100. In these FIGS., a emitter cover 128 is attached to and supported by the side wall 23 of the freezer compartment 16. The emitter cover 128 supports the emitter PCB 104 within an emitter housing 129. The side wall 23 is captured between the emitter cover 128 and the emitter housing 129 which are attached together using suitable fasteners.

A paddle 130 is also rotatably connected to the emitter cover 128 along a front edge 130*a*. The paddle 130 may be connected in any conventional manner including via an axle pin 131 which passes through a pair of tabs 132 extending from the paddle and also passes through a spring 134. The pin 131 connects to the cover 128. The spring 134 is positioned to bias the paddle 130 to rotate outwardly, away from the emitter cover 128 into an open position. The paddle 130 includes an opening or hole 136 which aligns with the line of sight 120 between the LED 106 and the phototransistor 110 when the paddle is rotated back into its recessed position as described further hereinbelow.

Figure 8:
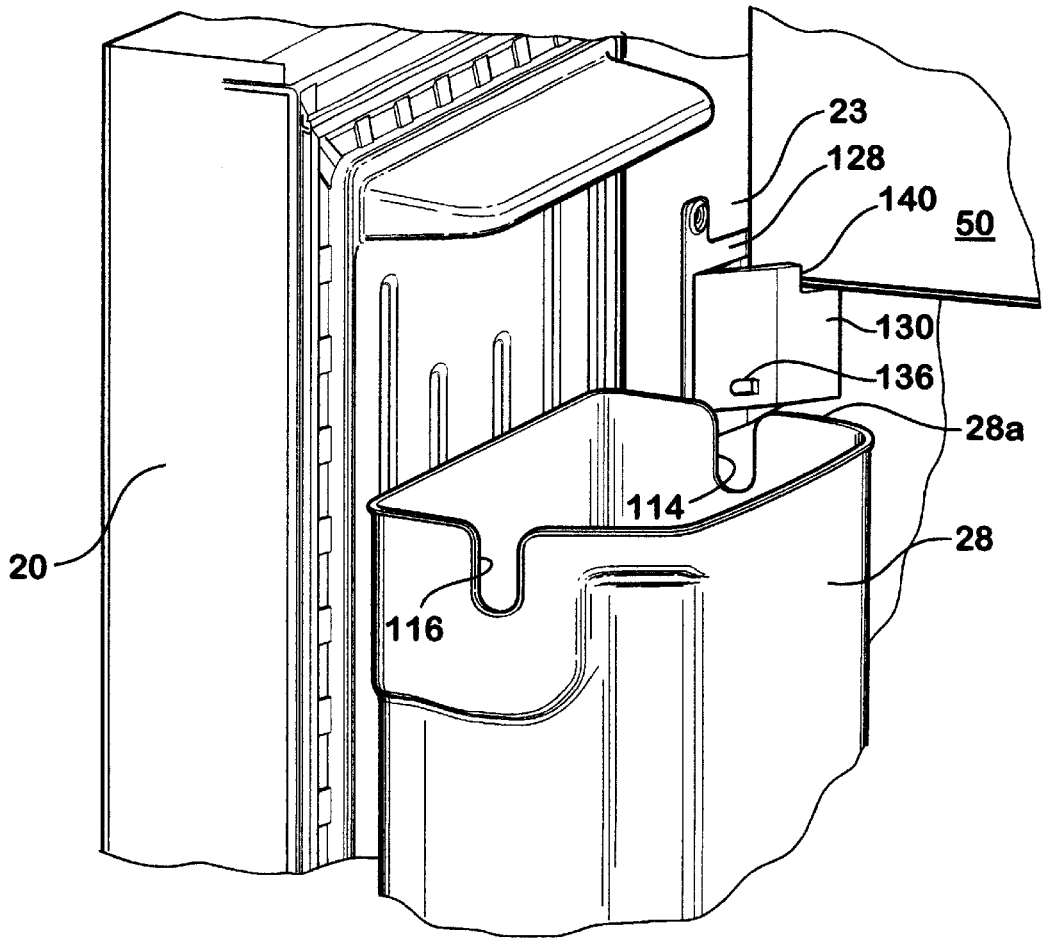
FIG. 8 is a fragmentary perspective view illustrating the door of the freezer compartment open.
Figure 10:
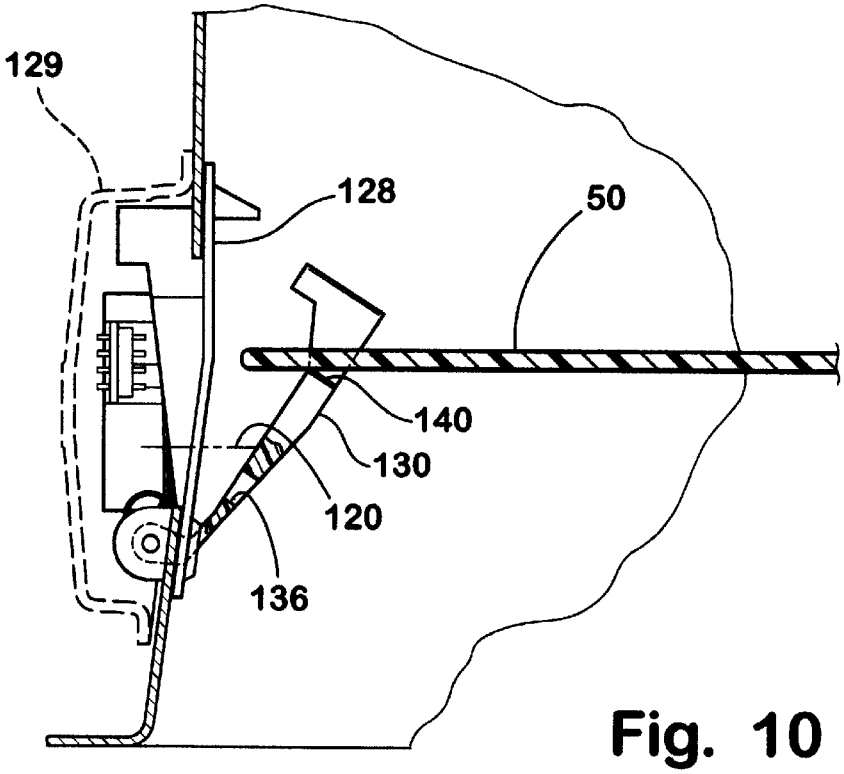
FIG. 10 is an enlarged cross-sectional view through the upper portion of the ice storage bin along the line of sight illustrating the paddle in an open position and engaging the cover.

When the freezer door 20 is rotated open, the bin 28 moves with the door 20. This allows the paddle 130 to rotated outwardly, under the bias of the spring 134 to its open position, as best shown in FIGS. 8 and 10. In such a position, the hole 136 is moved out of alignment with the line of sight 120 such that the any light emitted from the LED 106 is blocked from reaching the phototransistor 110 by the paddle 130. This will ensure that the ice maker 22 does not effect an ice harvest when the door 20 is open.

Figure 9:
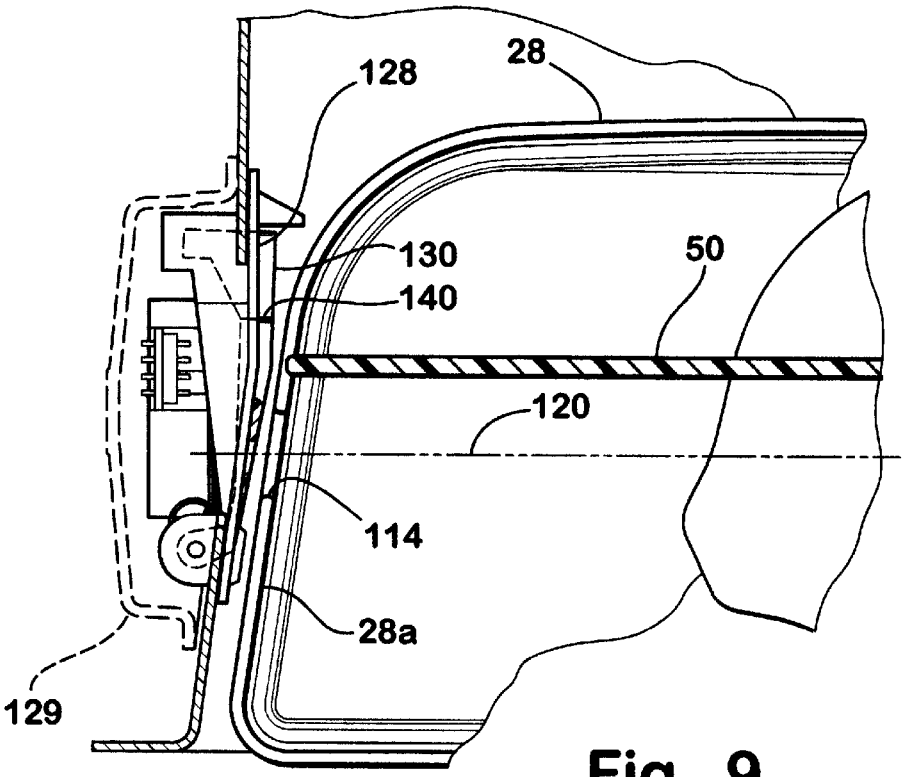
FIG. 9 is an enlarged cross-sectional view through the upper portion of the ice storage bin along the line of sight illustrating the paddle in a recessed position.

When the freezer door 20 is closed, a contact side 28*a* of the bin 28 is rotated into engagement with the paddle 130 and causes the paddle to rotate into its recessed position—shown in FIGS. 5 and 9. In its recessed position, the hole 136 of the paddle 130 is aligned with the line of sight 120 between the optic elements such that the optic system can function as described above.

The paddle 130 is also provided with a stop surface 140 which, when the paddle 130 is rotated outwardly to its open position, the stop surface 140 is positioned adjacent the cover 50 which hangs down in front of the ice maker 22. As described above, the cover 50 must move outwardly to allow ice pieces to fall off the ramp 38*a* and drop into the bin 28—since that gap between the outer edge of the ramp 138*a* and the cover 50 is too small to allow ice pieces to pass therethrough. If the freezer door 20 is opened during an ice harvest, it is possible that the ice maker would complete its harvest and cause ice pieces to slide down the ramp 38*a*. By positioning the stop surface 140 adjacent the cover 50 when the freezer door 20 is open, the cover 50 is prevented from moving outwardly by the stop surface. This precludes any ice pieces from passing through the gap between the outer edge of the ramp 38*a* and the cover 50 when the freezer door 20 is open.

It can be understood that that the paddle assembly provides several functions. It supports the emitter element or LED 106. If provides a means for blocking the optic path 120 hen the freezer door is open so that ice harvesting does not occur when the freezer door is open. It also locks the cover 50 into a closed position when the freezer door 20 is opened such that ice dispensing from the ice maker is prevented when the freezer door 20 is opened.

Figure 11:
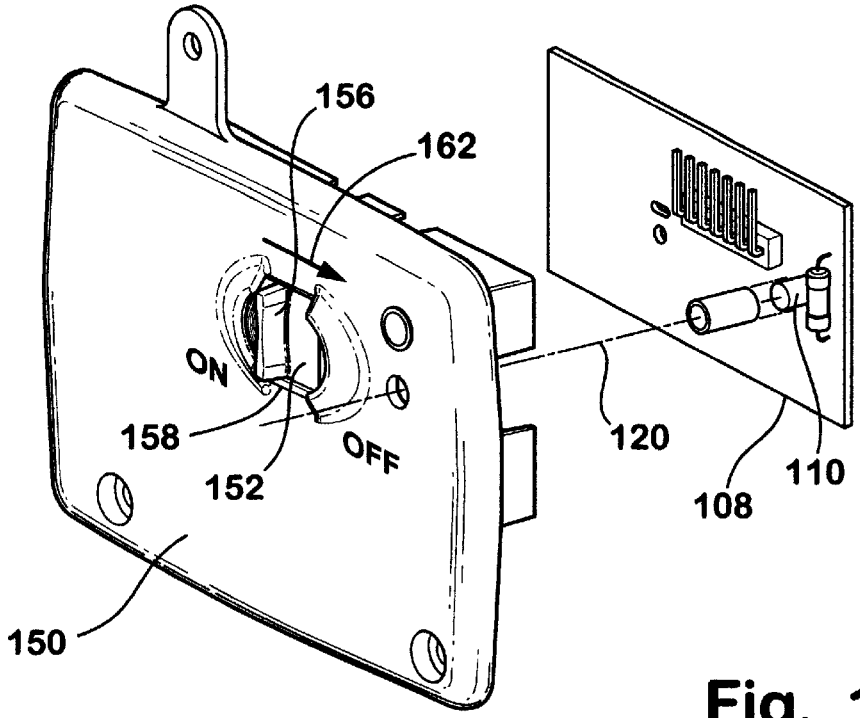
FIG. 11 is a front perspective, exploded view of the receiver assembly showing the slide member in an ON position.
Figure 12:
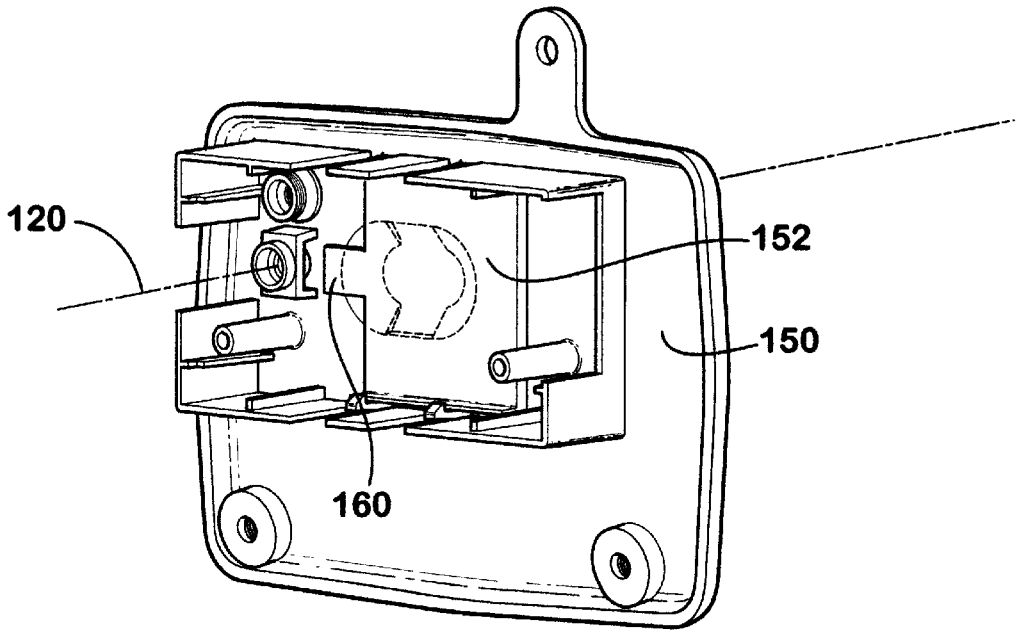
FIG. 12 is a rear perspective view of the receiver assembly showing the slide member in an ON position.

Turning now to FIGS. 11 and 12 in combination with FIG. 6, further details associated with the receiver assembly 102 can be explained. The receiver assembly may be configured to provide an ON/OFF switch to deactivate the ice maker. The benefits of such a switch are well know and may be beneficially used during periods when the refrigerator 10 is not being used-such as during a vacation period.

The receiver assembly 102 includes a receiver cover 150 which is attached to and supported by the side wall 21 of the freezer compartment 16. The receiver cover 150 supports the receiver PCB 108 within a receiver housing 154. The side wall 21 is captured between the receiver cover 150 and the receiver housing 154 which are attached together using suitable fasteners.

A slidable member or slide member 152 is slidably supported along the back surface of the receiver cover 150. The slide 152 includes a tab or rib 156 which extends through an opening 158 provided in the cover 150. When the cover 150 is assembled to the side wall 21, the tab 158 allows for manual movement of the slide 152 between an ON and OFF position. The slide further includes a portion 160 which may be selectively moved into an interference position with the line of sight 120 between the optic elements 106 and 110—depending on the position of the slide 152.

Both FIGS. 11 and 12 illustrate the slide 152 positioned in its ON position wherein the line of sight 120 is not blocked. However, when the tab 158 is manually moved in the direction labeled 162, into the OFF position, the line of sight 120 is blocked. The slide assembly, therefore, can be used as an ON/OFF switch for the ice maker 22. Whenever the slide is moved to its ON position, the line of sight 120 is not blocked and the ice maker can be operated as described above—harvesting ice whenever the optic system indicates that the bin 28 is not full of ice pieces. However, when the slide 152 is moved into its OFF position, the line of sight 120 is blocked and the ice maker 22 is prevented from any further harvesting. In the OFF position, the optic control system will never allow the ice maker to harvest ice pieces.

Figure 13A:
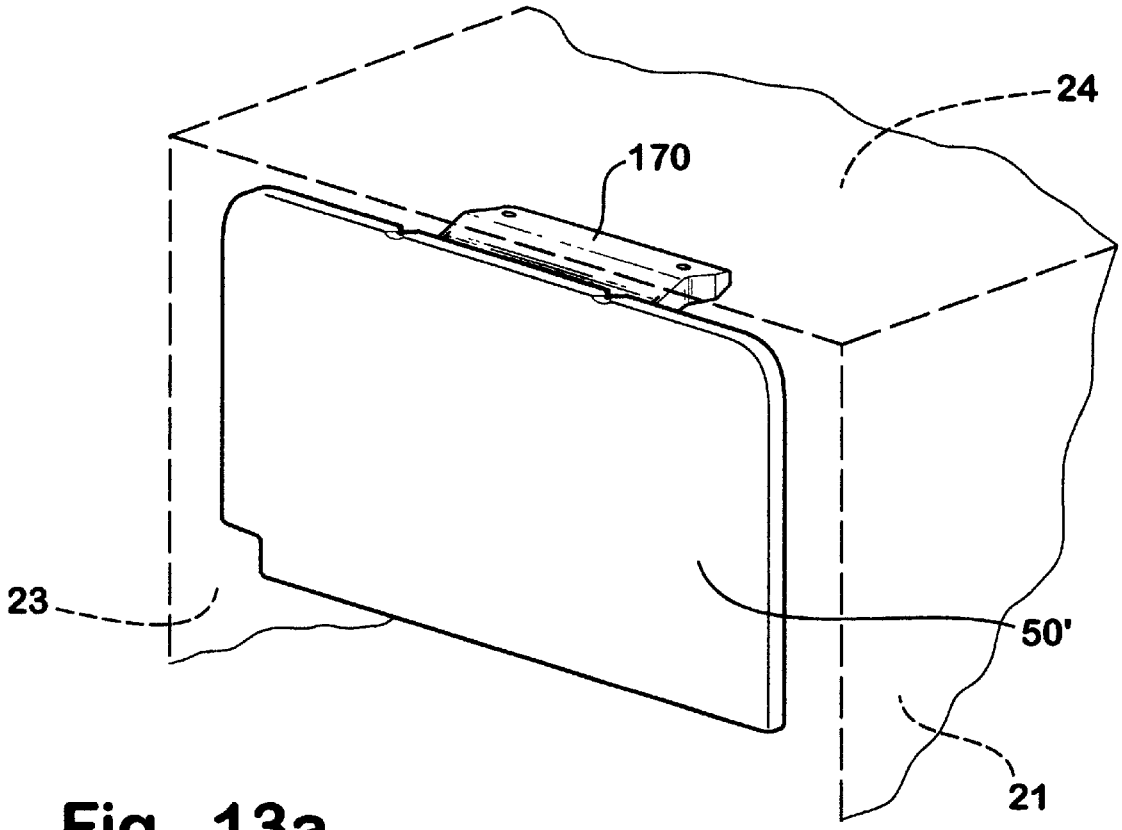
FIG. 13*a* is a front perspective view of a second embodiment of the front cover and the bracketry used to support the cover in front of the ice maker.
Figure 13B:
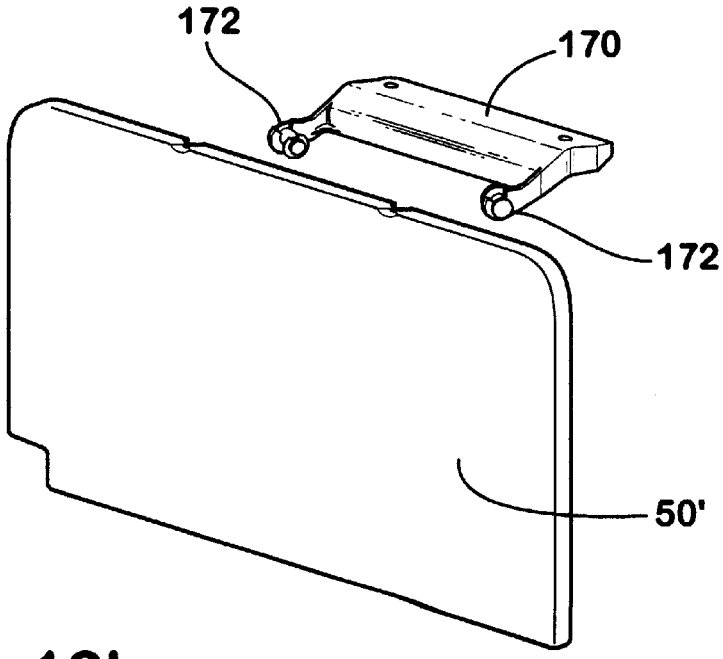
FIG. 13*b* is an exploded, front perspective view of the second embodiment of the front cover and the bracketry used to support the cover in front of the ice maker.

Turning now to FIGS. 13*a* and 13*b*, details of a second embodiment for supporting the front cover can be explained. As discussed above with regard to FIGS. 3 and 4, the front cover 50 may be attached to bracket tabs 48 such that the cover is rotatably supported in front of the ice maker 22. In the second embodiment, a front cover 50' is supported in front of an ice maker (not shown) by a bracket 170, mounted directly to the top wall 24 of the freezer compartment. It can be seen that the bracket 170 does not form part of the bracket that supports the ice maker. The ice maker can be supported by bracket structure attached to the freezer side walls of the top wall.

In FIGS. 13*a* and 13*b*, the front cover 50' is a generally flat member or wall having a back surface and a front surface and is pivotably supported in front of the ice maker. The bracket 170 includes a support arms 172 which rotatably engage extensions (not shown) extending from the back surface of the cover 50'.

It can be seen, therefore, that the present invention provides a unique system for preventing the discharge of ice pieces out of an ice making system which includes an ice storage bin is mounted on the freezer door. Moreover, the present system is beneficially combined with an optical ice level sensing system and provides a simple way to deactivate an ice maker.

Many changes can readily be made to the above described embodiments without departing from the scope of the claims. For example, many different shapes and sizes of paddles may be used. The slide member can be movably supported in any fashion that allows for selective movement to block the line of sight and is not limited to just sliding motion. The cover could be supported in any number of known ways such that the cover is movably supported in front of the ice maker. Likewise, the paddle and slide can be supported on the freezer walls in any number of know ways for rotatably and movably attaching mechanical elements.

It can be appreciated that the optic sensing system of the present invention—shown in the form of a sensor pair—can be any type of system which includes a source of optical energy and a detector of optical energy. Although an LED and a phototransistor are shown, there may be other types of optical elements which could be suitable for use with the present invention.

The present invention is not intended to be limited by any particular optical ice level sensing system and can be beneficially employed with any type of optical system having a emitter element and a receiver element with a line of sight therebetween.

Accordingly, while the present invention has been described with reference the above described embodiment, those of skill in the Art will recognize that changes may be made thereto without departing from the scope of the invention as set forth in the appended claims.

We claim:

1. A refrigerator including a freezer compartment having a plurality of walls and an access opening and a door for closing the access opening, the refrigerator comprising:

an ice maker being disposed within the freezer compartment for forming ice pieces;

an ice storage bin mounted to the door below the ice maker for receiving ice from the ice maker;

an emitter element supported on one of the freezer walls for emitting a beam of light across the upper portion of the bin;

a receiver element supported on one of the freezer walls opposite the emitter element for receiving the beam of light, the beam of light traveling between the emitter element and the receiver element along a line of sight path; and a paddle rotatably supported on one of the freezer walls for blocking the line of sight when the door is open.

2. The refrigerator according to claim 1, further wherein the paddle is rotatable supported between a recessed position and an open position, the paddle is biased away from the freezer wall toward its open position, the paddle has an opening which is in alignment with the line of sight when the paddle is in a recessed position and which is out of alignment with the line of sight when the paddle is in its open position, such that when the door is closed, the bin engages the paddle and rotates the paddle to its recessed position such that the opening in the paddle aligns with the line of sight and when the door is open such that the bin no longer engages the paddle, the paddle moves to its open position wherein opening of the paddle is out of alignment with the line of sight.

3. The refrigerator according to claim 1, further comprising:

a cover movably supported adjacent the ice maker such that ice pieces must pass by and move the cover to discharge from the ice maker to the ice storage bin, wherein the paddle includes a stop surface which interferes with cover movement when the paddle is in its open position such that ice pieces can not fall past the cover when the door is open.

4. The refrigerator according to claim 1, further comprising:

a cover movably supported adjacent the ice maker such that ice pieces must pass by and move the cover to discharge from the ice maker to the ice storage bin, wherein the paddle blocks cover movement when the door is open such that ice pieces can not fall past the cover when the door is open.

5. The refrigerator according to claim 1, further comprising:

an emitter cover for supporting the emitter element and for further rotataby supporting the paddle, the emitter cover being attached to one of the freezer walls.

6. The refrigerator according to claim 1, where in the paddle has a front edge and a rear edge, the front edge is rotatably connected to one of the freezer walls and a spring biases the paddle outwardly away from the first freezer wall such that the paddle rotates outwardly when the door is opened.

7. The refrigerator according to claim 6, wherein the ice storage bin engages the paddle and moves the paddle into a non blocking position when the door is closed such that the line of sight is not blocked when the door is closed.

8. A refrigerator including a freezer compartment having an access opening and a door for closing the access opening, the refrigerator comprising:

an ice maker being disposed within the freezer compartment for forming ice pieces;

an ice storage bin mounted to the door below the ice maker for receiving ice from the ice maker;

an emitter element supported on a first freezer wall for emitting a beam of light across the upper portion of the bin;

a receiver element supported on a second freezer wall for receiving the beam of light, the beam of light traveling between the emitter element and the receiver element along a line of sight path;

means for blocking the line of sight when the door is open.

9. The refrigerator according to claim 8, further comprising:

a cover movably supported adjacent the ice maker such that ice pieces must pass by and move the cover to discharge from the ice maker to the ice storage bin; and means for blocking the movement of the cover when the freezer door is open such that ice pieces can not fall past the cover when the door is open.

10. A refrigerator including a freezer compartment having a plurality of walls and having an access opening and a door for closing the access opening, the refrigerator comprising:

an ice maker being disposed within the freezer compartment for forming ice pieces;

an ice storage bin mounted to the door below the ice maker for receiving ice from the ice maker;

an emitter element supported on one of the freezer walls for emitting a beam of light across the upper portion of the bin;

a receiver element supported on one of the freezer walls opposite the emitter element for receiving the beam of light, the beam of light traveling between the emitter element and the receiver element along a line of sight path;

a movable member supported on one of the freezer walls and being selectively movable to block the line of sight.

11. The refrigerator according to claim 10, wherein the movable member comprises:

a slide member slidably attached to the second freezer wall and movable between an ON and OFF position wherein in the OFF position, the line of sight is blocked.

12. The refrigerator according to claim 10, further comprising:

a cover mounted to one of the freezer walls, the cover having a front surface facing the freezer compartment and a back surface, the cover further having an opening, the movable member being slidably supported along the back surface of the cover between an OFF position and an ON position, the movable member having a tab extending outwardly through the opening into the freezer compartment.

13. A refrigerator including a cabinet for defining a freezer compartment having top wall, a first side wall, a second side wall and an access opening, the refrigerator comprising:

a door for closing the access opening;

an ice maker being disposed within the freezer compartment adjacent the top wall for forming ice pieces;

an ice storage bin removably mounted to the door below the ice maker for receiving ice pieces from the ice maker;

an emitter element supported on the first side wall for emitting a beam of light across the upper portion of the bin;

a receiver element supported on the second side wall opposite the emitter element for receiving the beam of light, the beam of light traveling between the emitter element and the receiver element along a line of sight path;

a paddle rotatably supported on the first side wall for blocking the line of sight when the door is open; and a movable member supported on the second wall and being selectively movable to block the line of sight.

14. The refrigerator according to claim 13, further wherein the paddle is rotatably supported between a recessed position and an open position, the paddle is biased away from the freezer wall toward its open position, the paddle has an opening which is in alignment with the line of sight when the paddle is in a recessed position and which is out of alignment with the line of sight when the paddle is in its open position, such that when the door is closed, the bin engages the paddle and rotates the paddle to its recessed position wherein the opening in the paddle aligns with the line of sight and when the door is open such that the bin no longer engage the paddle, the paddle moves to its open position wherein opening of the paddle is out of alignment with the line of sight.

15. The refrigerator according to claim 14, further comprising:

a cover movably supported adjacent the ice maker such that ice pieces must pass by and move the cover to discharge from the ice maker to the ice storage bin, wherein the paddle includes a stop surface which interferes with cover movement when the paddle is in its open position such that ice pieces can not fall past the cover the door is open.

16. The refrigerator according to claim 13, further comprising:

a cover movably supported adjacent the ice maker such that ice pieces must pass by and move the cover to discharge from the ice maker to the ice storage bin, wherein the paddle blocks cover movement when the door is open.

17. A refrigerator including a freezer compartment having a plurality of walls and an access opening and a door for closing the access opening, the refrigerator comprising:

an ice maker being disposed within the freezer compartment for forming ice pieces;

an ice storage bin mounted to the door below the ice maker for receiving ice from the ice maker;

an emitter element supported on one of the freezer walls for emitting a beam of light across the upper portion of the bin;

a receiver element supported on one of the freezer walls opposite the emitter element for receiving the beam of light, the beam of light traveling between the emitter element and the receiver element along a line of sight path;

a cover movably supported adjacent the ice maker such that ice pieces must pass by and move the cover to discharge from the ice maker to the ice storage bin;

a paddle rotatably supported on one of the freezer walls adjacent the cover and wherein the paddle blocks cover movement when the door is open such that ice pieces can not fall past the cover when the door is open.

18. The refrigerator according to claim 17, further wherein the paddle is rotatably supported between a recessed position and an open position, the paddle is biased away from the freezer wall toward its open position, the paddle has an opening which is in alignment with the line of sight when the paddle is in a recessed position and which is out of aligmnent with the line of sight when the paddle is in its open position, such that when the door is closed, the bin engages the paddle and rotates the paddle to its recessed position such that the opening in the paddle aligns with the line of sight and when the door is open such that the bin no longer engages the paddle, the paddle moves to its open position wherein opening of the paddle is out of alignment with the line of sight.

19. The refrigerator according to claim 17, wherein the paddle has a front edge and a rear edge, the front edge is rotatably connected to one of the freezer walls and a spring biases the paddle outwardly away from the first freezer wall such that the paddle rotates outwardly to block movement of the cover when the door is opened.

20. The refrigerator according to claim 19, wherein the ice storage bin engages the paddle and moves the paddle into a non blocking position when the door is closed such that the cover is free to move when the door is closed.

21. The reftigerator according to claim 17, wherein the cover is rotatably supported from a top wall of the freezer compartment.

* * * * *